US009771901B2

(12) United States Patent
Park et al.

(10) Patent No.: US 9,771,901 B2
(45) Date of Patent: Sep. 26, 2017

(54) EXHAUST GAS RECIRCULATION VALVE HAVING CAM STRUCTURE FOR VEHICLE

(71) Applicant: HYUNDAI KEFICO CORPORATION, Gunpo-si, Gyeonggi-do (KR)

(72) Inventors: Chun-Su Park, Suwon-si (KR); Dong-Bin Shin, Gunpo-si (KR); Yong-Soon Park, Seongnam-si (KR)

(73) Assignee: HYUNDAI KEFICO CORPORATION, Gunpo-si, Gyeonggi-Do (KR)

( * ) Notice: Subject to any disclaimer, the term of this patent is extended or adjusted under 35 U.S.C. 154(b) by 114 days.

(21) Appl. No.: 14/995,536

(22) Filed: Jan. 14, 2016

(65) Prior Publication Data

US 2017/0204815 A1 Jul. 20, 2017

(51) Int. Cl.

| | |
|---|---|
| ***F02M 25/07*** | (2006.01) |
| ***F02M 26/67*** | (2016.01) |
| ***F02M 26/72*** | (2016.01) |

(52) U.S. Cl.

CPC ..... *F02M 26/67* (2016.02); *F02M 26/72* (2016.02)

(58) Field of Classification Search

CPC ..... F02M 26/67; F02M 26/72; F02M 26/65; F02M 26/52; F02M 26/63

See application file for complete search history.

(56) References Cited

U.S. PATENT DOCUMENTS

| | | | | |
|---|---|---|---|---|
| 5,467,756 | A * | 11/1995 | Fischer | F02M 26/63 123/568.3 |
| 6,571,782 | B2 * | 6/2003 | Brosseau | F02M 26/67 123/337 |
| 6,758,196 | B2 * | 7/2004 | Brosseau | F02M 26/67 123/568.18 |
| 8,490,605 | B2 | 7/2013 | Gracner et al. | 123/568.11 |

FOREIGN PATENT DOCUMENTS

| | | | |
|---|---|---|---|
| JP | 2014-040792 | A | 3/2014 |
| KR | 1995-0009405 | Y1 | 10/1995 |
| KR | 10-2010-0042779 | A | 4/2010 |
| KR | 10-2010-0096109 | A | 9/2010 |
| KR | 10-1225682 | B1 | 1/2013 |

* cited by examiner

*Primary Examiner* — Hieu T Vo

(74) *Attorney, Agent, or Firm* — Fitzpatrick, Cella, Harper & Scinto

(57) ABSTRACT

An exhaust gas recirculation valve having a cam structure for opening and closing a gas passage through which exhaust gas is recirculated to an intake manifold. The valve includes a valve housing having the gas passage, a valve unit linearly moving to selectively open and close the gas passage, a motor generating power to drive the valve unit, a valve actuator driving the valve unit to move linearly, and a power transmission transmitting the rotation force from the motor to the valve actuator. The valve actuator includes a power-transmission gear unit to transmit the rotation force from the motor, and the valve actuator includes an actuating gear unit to be rotated by being meshed with the power-transmission gear unit. The valve has a cam structure in which the power-transmission gear unit and the actuating gear unit are arranged in line with a direction of linear motion of the valve unit.

17 Claims, 7 Drawing Sheets

EXHAUST GAS RECIRCULATION VALVE HAVING CAM STRUCTURE FOR VEHICLE

BACKGROUND OF THE INVENTION

1. Technical Field

The present invention relates generally to an exhaust gas recirculation valve having a cam structure for a vehicle and, more particularly, to an exhaust gas recirculation valve having a cam structure for a vehicle, in which a gear unit for transmitting power to a valve unit and a valve-motion axis are arranged in a line such that the valve can be stably operated with power from a motor.

2. Description of the Related Art

Generally, in order to restrict generation of nitrogen oxides (NOx) from a vehicle engine, a portion of the exhaust gas that is cooled by an exhaust gas recirculation (EGR) valve is added to a fuel air mixture and then is fed to a cylinder.

For the recirculation of exhaust gas, an exhaust gas recirculation passage is formed between an exhaust manifold and a downstream of a throttle valve of an intake manifold and an exhaust gas recirculation valve is installed in the passage to open and close the passage.

The exhaust gas recirculation valve includes a housing that has a gas passage through which exhaust gas is introduced and discharged, a valve unit that selectively opens and closes the gas passage, a motor that generates power to operate the valve unit, and a power transmission that transmits rotation force from the motor to the valve unit.

The power transmission transmits the rotation force from the motor to the valve unit while converting the rotation force to a linear motion, so that, when the motor is driven, the valve unit is linearly moved and selectively opens and closes the gas passage.

However, a conventional exhaust gas recirculation valve has a problem in that power transmission gears in the power transmission are arranged in a misaligned manner, and a side of a rotary axis of the gear is only supported by the housing, so that an amount of power loss occurs due to side force and friction force during transmission of power from the motor and the operation is not stable, resulting in reduced reliability in opening and closing the gas passage for the recirculation of exhaust gas.

Further, in use, the power transmission is not smooth due to vibrations occurring on the rotary axis, which causes a considerable amount of power loss and frequently damages the rotary axis and gears.

SUMMARY OF THE INVENTION

Accordingly, the present invention has been made keeping in mind the above problems occurring in the related art, and an object of the present invention is to provide an exhaust gas recirculation valve having a cam structure for a vehicle, in which a gear for receiving power from a motor and a valve-motion axis are arranged in a line so as to reduce friction force due to a reduced side force to ensure a stable operation, thereby improving operation reliability of the valve for the recirculation of exhaust gas.

In order to accomplish the above object, the present invention provides an exhaust gas recirculation valve having a cam structure for opening and closing a gas passage through which exhaust gas from an internal engine of a vehicle is recirculated to an intake manifold, the valve including: a valve housing having the gas passage through which exhaust gas is introduced and discharged; a valve unit linearly moving to selectively open and close the gas passage; a motor generating power to drive the valve unit; a valve actuator receiving rotation force from the motor to drive the valve unit to move linearly; and a power transmission transmitting the rotation force from the motor to the valve actuator, wherein the valve actuator includes a power-transmission gear unit to transmit the rotation force from the motor, and the valve actuator includes an actuating gear unit that is to be rotated by being meshed with the power-transmission gear unit, and wherein the valve has a cam structure in which the power-transmission gear unit and the actuating gear unit are arranged in line with a direction of linear motion of the valve unit.

The actuating gear unit may be integrally provided with a cam hole eccentric from center of rotation, and the valve actuator may include: an actuating roll part inserted into the cam hole to roll over in the cam hole; and a roll bracket part provided to an end of the valve unit and to which the actuating roll part is rotatably connected.

The valve actuator may further include a spring part elastically supporting the valve unit.

The cam hole may be configured such that one side thereof is close to a rotation axis of the actuating gear unit and the other side thereof is far from the rotation axis of the actuating gear unit.

The valve unit may include a valve-motion axis to be linearly moved by the valve actuator and a valve disc provided on an end of the valve-motion axis to open and close an outlet of the gas passage, the roll bracket part may include first and second roll supports disposed on opposite sides of the actuating gear unit to support opposite ends of a roll axis of the actuating roll part, and a bracket bottom part connecting the first and second supports at the outside of the actuating gear unit and to which the end of the valve-motion axis is attached.

A main gear part may be provided on a motor shaft of the motor, and the power-transmission gear unit may include a first middle gear part meshed with the main gear part, and a second middle gear part having a smaller diameter than the first middle gear part and protruding from one side of the first middle gear part so as to be meshed with the actuating gear unit, wherein the second middle gear part, the actuating gear unit, the actuating roll part, and the valve-motion axis are arranged along a same vertical line.

The first middle gear part and the main gear part may be meshed with each other such that the first middle gear part and the main gear part are disposed apart from and parallel with the actuating gear unit.

The valve housing may include a base body part attached to a vehicle body, a first axial support part extending upwards from an upper surface of the base body part to support one side of the power-transmission gear unit and the actuating gear unit, a second axial support part extending upwards from the upper surface of the base body part while being disposed apart from the first axial support part, to support the other side of the power-transmission gear unit and the actuating gear unit, and through which the motor shaft of the motor passes, a motor-accommodating part extending from the second axial support part towards an opposite side of the first axial support part so as to accommodate the motor therein, and a passage body part extending downwards from a lower surface of the base body part to form the gas passage, through which exhaust gas is introduced and discharged, and which is opened and closed by the valve unit.

The valve housing may further include a cover for a motor-accommodating part covering an open one side of the motor-accommodating part, wherein the cover is coupled to the open one side of the motor-accommodating part to shield the inside of the motor-accommodating part after the motor is accommodated in the motor-accommodating part such that the motor shaft of the motor passes through and protrudes out of a through-hole of the second axial support part.

The first axial support part may have a width smaller than that of the second axial support part, and the valve housing may further include first and second connecting frames connecting lower portions of the first and second axial support parts, respectively and each having an upper recessed portion that is provided so as to be separated from the actuating gear unit.

The base body part may be provided with a lower spring support protruding between the first and second axial support parts and having a hole for the motion axis, wherein the lower spring support has, on an outer circumference thereof, a circular groove in which a lower portion of the spring part is inserted and seated, and the valve-motion axis may be provided, on an upper portion thereof, with an upper spring support by which an upper portion of the spring part is supported.

The valve-motion axis may pass through the hole for the motion axis, and an axial guide bushing may be provided in the hole to guide a vertical linear motion of the valve-motion axis.

The axial guide bushing may be provided with a plurality of guide bushings spaced apart from each other in the hole for the motion axis.

Any one of the first and second axial support parts may be provided with a motion guide slit extending in a direction in which the valve unit moves, and the valve may further include, in the motion guide slit, a magnet body that is connected with and moves along with the valve unit, and a Hall sensor for detecting a position of the magnet body.

The passage body part may be provided with the gas passage, through which exhaust gas is introduced and discharged, and the outlet of the gas passage opened and closed by the valve disc, and the gas passage may be provided with an inclined wall for guiding exhaust gas introduced from an inlet of the gas passage towards the outlet of the gas passage.

The valve actuator may further include a rotation stopper for restricting rotation of the actuating gear unit to a predetermined range.

An arcuate stopper groove or hole may be provided on a lateral side of the actuating gear unit to restrict a radius of rotation of the actuating gear unit, and the rotation stopper may be provided with a stopper pin extending from any one of the first and second axial support parts so as to be fitted into the stopper groove or hole.

According to the present invention, the gear for receiving power from the motor and the valve-motion axis are arranged in a line so as to reduce friction force due to a reduced side force to minimize a power loss during power transmission and to ensure stable operation for opening and closing the gas passage, thereby improving operation reliability of the valve for the recirculation of exhaust gas.

Further, the present invention provides an effect that with the configuration of an actuating gear unit and a cam being integrally formed, manufacturing cost is reduced and a stable operation for opening and closing the gas passage is ensured, thereby further improving operation reliability of the valve for the recirculation of exhaust gas.

Furthermore, the present invention provides an effect that with the configuration of the rotation axis of the power-transmission gear unit being supported at opposite ends thereof, when the gear unit is operated, vibration is prevented from being generated, thereby improving durability of the gear unit and the rotation axis.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
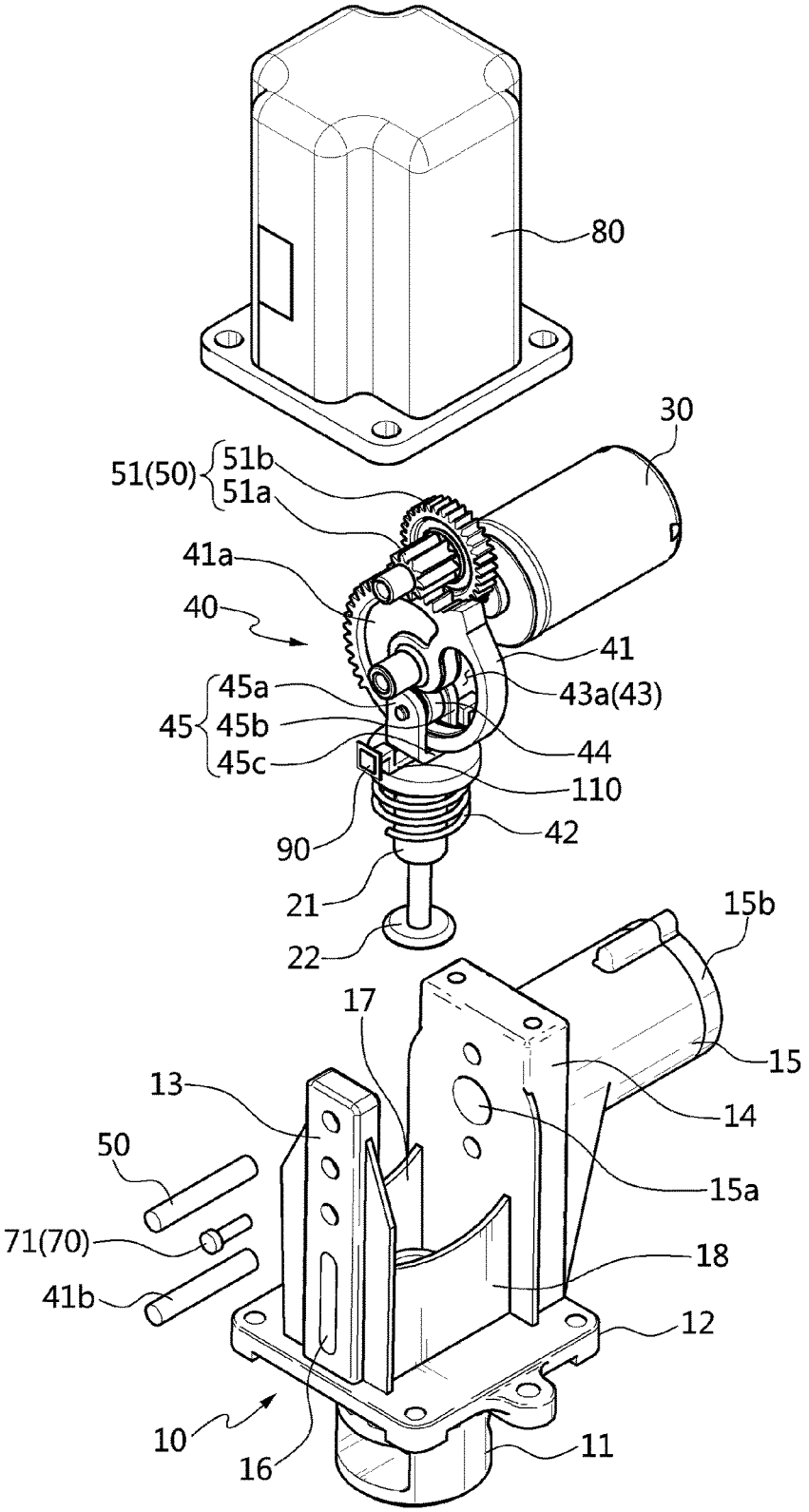
FIG. 1 is an exploded perspective view showing an exhaust gas recirculation valve having a cam structure for a vehicle according to an embodiment of the present invention.

The present invention will be described in detail below with reference to the accompanying drawings. Repeated descriptions and descriptions of known functions and configurations which have been deemed to make the gist of the present invention unnecessarily obscure will be omitted below. The embodiments of the present invention are intended to fully describe the present invention to a person having ordinary knowledge in the art to which the present invention pertains. Accordingly, the shapes, sizes, etc. of components in the drawings may be exaggerated to make the description clearer.

The present invention relates to an exhaust gas recirculation (EGR) valve having a cam structure for a vehicle for opening and closing a passage for recirculating exhaust gas generated from an internal engine to an intake manifold.

Figure 2:
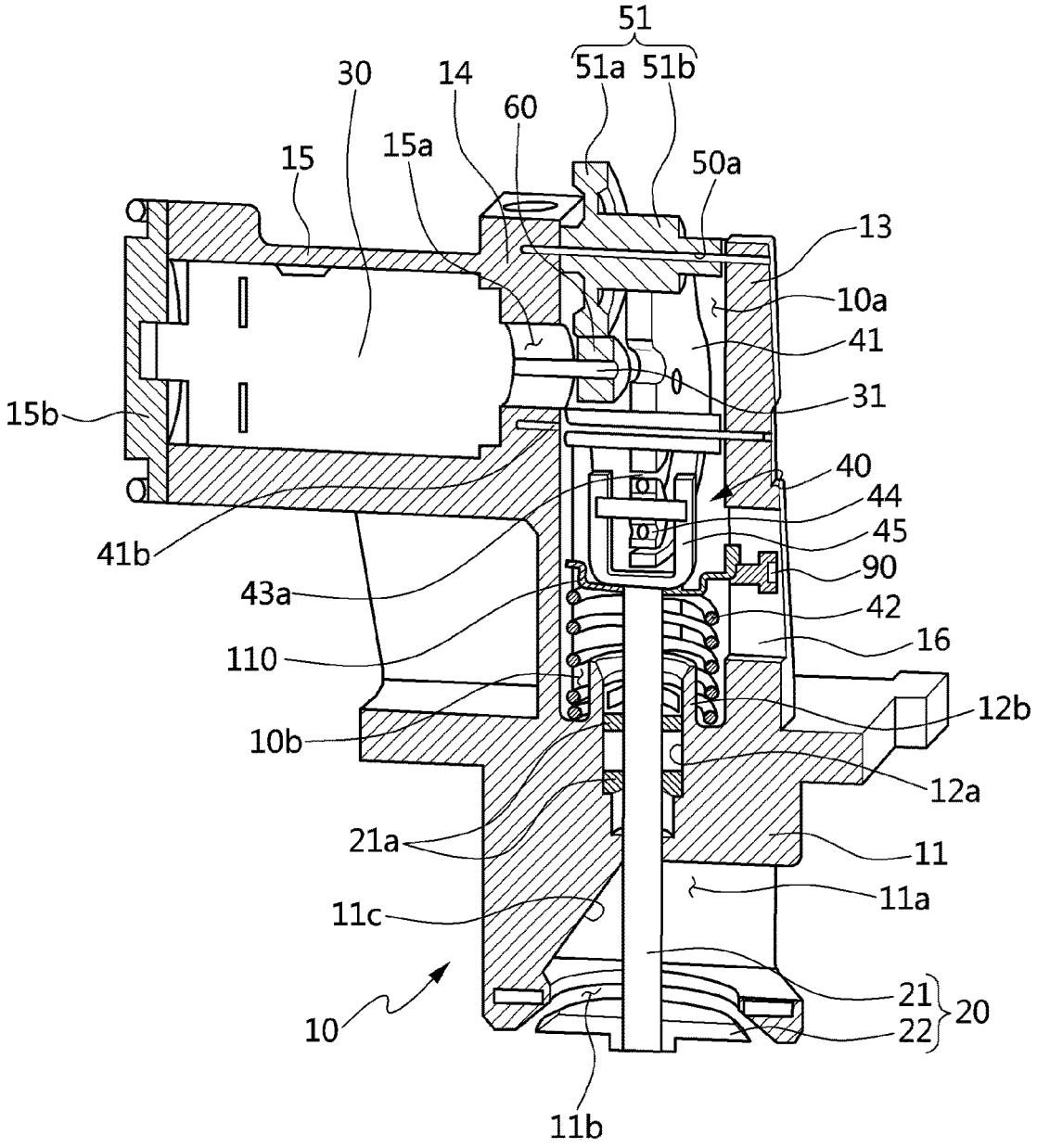
FIG. 2 is a cross-sectional perspective view showing the exhaust gas recirculation valve having a cam structure for a vehicle.

FIG. 1 is an exploded perspective view showing an exhaust gas recirculation valve having a cam structure for a vehicle according to an embodiment of the present invention, and FIG. 2 is a cross-sectional perspective view showing the exhaust gas recirculation valve having a cam structure for a vehicle.

Figure 3:
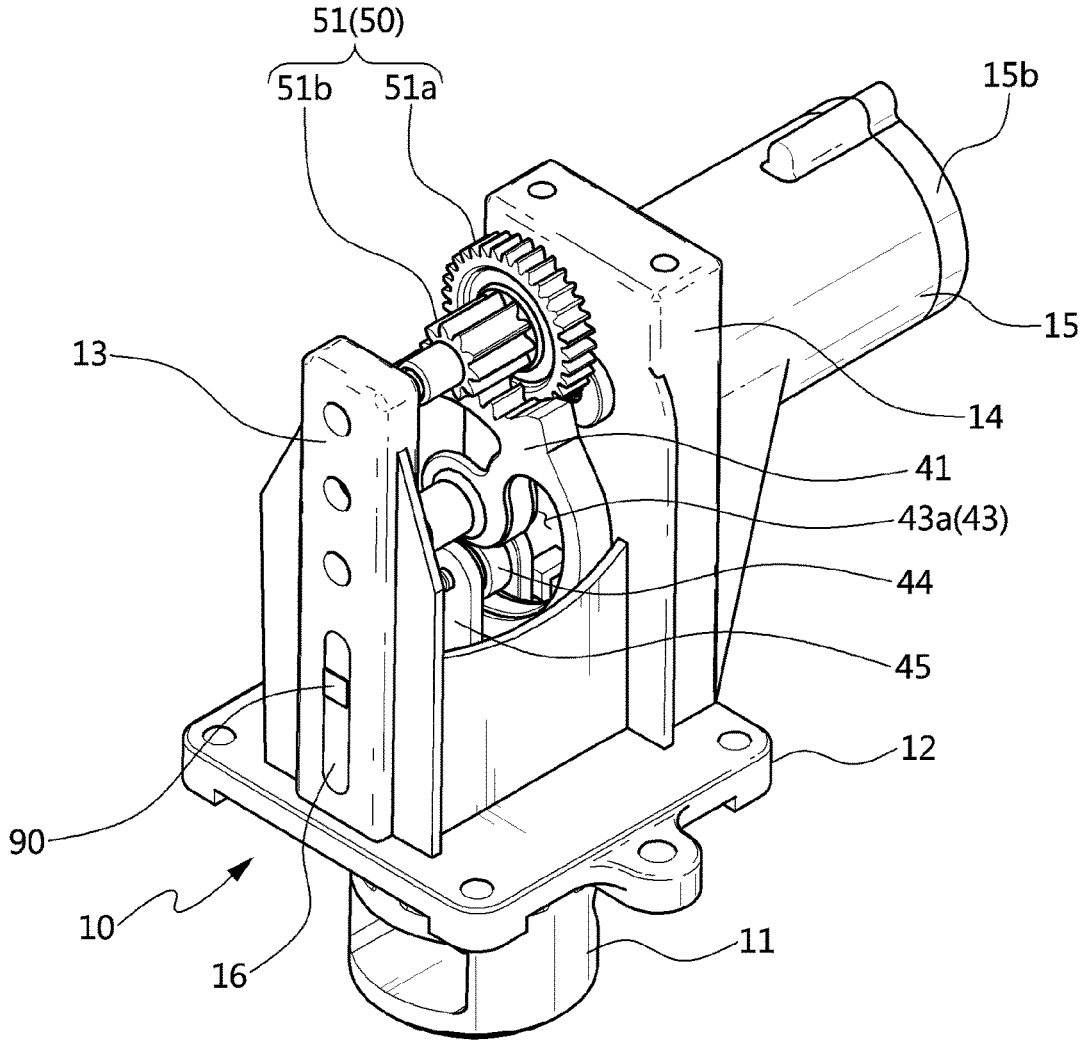
FIG. 3 is a perspective view showing the exhaust gas recirculation valve having a cam structure for a vehicle.
Figure 4:
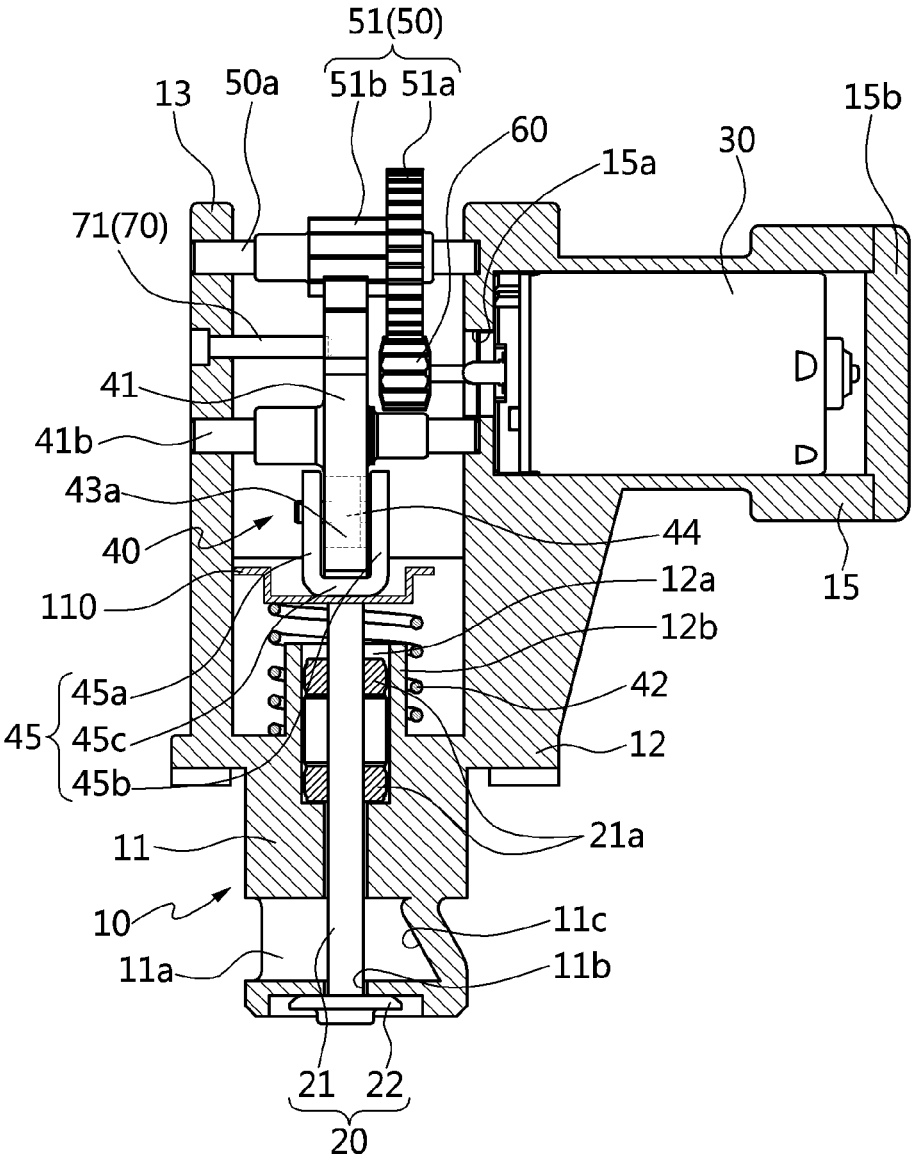
FIG. 4 is a cross-sectional view showing the exhaust gas recirculation valve having a cam structure for a vehicle.

FIG. 3 is a perspective view showing the exhaust gas recirculation valve having a cam structure for a vehicle, and FIG. 4 is a cross-sectional view showing the exhaust gas recirculation valve having a cam structure for a vehicle.

An embodiment of the exhaust gas recirculation valve will now be described in detail with reference to FIGS. 1 to 4.

The EGR valve includes a valve housing 10 that has a gas passage 11*a* through which exhaust gas is introduced and discharged, a valve unit 20 that selectively opens and closes the gas passage 11*a*, a motor 30 that generates power to actuate the valve unit 20, and a power transmission 50 that transmits rotation force from the motor 30 to the valve unit 20 to actuate the valve unit 20.

The EGR valve further includes a valve actuator 40 that receives rotation force of the motor 30 from the power transmission 50 to linearly move the valve unit 30. The valve actuator 40 linearly moves the valve unit 30 to selectively open and close the gas passage 11*a* of the valve housing 10.

The valve unit 20 includes a valve-motion axis 21 that is linearly moved by the valve actuator 40, and a valve disc 22 that is provided on an end of the valve-motion axis 21 to open and close an outlet 11*b* of the gas passage 11*a*.

The power transmission 50 includes a power-transmission gear unit 41 that transmits rotation force of the motor 30 to the valve actuator 40, the power-transmission gear unit 51 is supported by the valve housing 10 such that it can be rotated by a first rotation axis 50*a*.

The valve housing 10 is provided with first and second axial support parts 13 and 14 that support opposite ends of the first rotation axis 50*a*, respectively.

That is, the opposite ends of the first rotation axis 50*a* are coupled with and supported by the first and second axial support parts 13 and 14, respectively.

The valve housing 10 includes a passage body part 11 that is provided with the gas passage 11*a* through which exhaust gas is introduced and discharged, and a base body part 12 that is attached to a vehicle body. The base body part 12 is provided with a hole 12*a* which communicates with the gas passage 11*a* and through which the valve-motion axis 21 passes. The first and second axial support parts 13 and 14 separately stand on the base body part 12.

More specifically, the valve housing 10 includes the base body part 12 for mounting the valve housing to a vehicle body, the first axial support part 13 that extends upwards from an upper surface of the base body part 12 so as to support one side of the power-transmission gear unit 51, the second axial support part 14 that extends upwards from the upper surface of the base body part 12 separately from the first axial support part 13 so as to support the other side of the power-transmission gear unit 51, and through which a motor shaft 31 of the motor 30 passes, a motor-accommodating part 15 that extends opposite to the first axial support part 13 from the second axial support part 14 so as to accommodate the motor 30 therein, and the passage body part 11 that extends downwards from a lower surface of the base body part 12 so as to form the gas passage 11*a* therein, which is opened and closed by the valve unit.

The first and second axial support parts 13 and 14 support opposite sides of an actuating gear unit 41 of the valve actuator 40 as well as the opposite sides of the power-transmission gear unit 51. This will be described later in detail.

A gear chamber 10*a* is provided between the first and second axial support parts 13 and 14 to accommodate a plurality of power transmission gears, such as the power-transmission gear unit 51, the actuating gear unit 41, and the like.

The first axial support part 13 may have a width that is smaller than that of the second axial support part 14.

Since the motor-accommodating part 15 is provided on one side of the second axial support part 14, the second axial support part 14 has a width that may be sufficient to cover a width of the motor-accommodating part 15 corresponding to a diameter of the motor 30.

The valve housing 10 further includes a cover 15*b* for the motor-accommodating part that covers an open one side of the motor-accommodating part 15.

The cover 15*b* is coupled to the open one side of the motor-accommodating part 15 to shield the inside of the motor-accommodating part 15 after the motor 30 is accommodated in the motor-accommodating part 15 such that the motor shaft 31 of the motor 30 passes through and protrudes out of a through-hole 15*a* of the second axial support part 14.

The valve housing 10 may further include first and second connecting frames 17 and 18 that connect lower portions of the first and second axial support parts 13 and 14, respectively. The first and second connecting frames 17 and 18 each have an upper recessed portion that is provided so as to be separated from the actuating gear unit 41, thereby preventing interference with the rotation of the actuating gear unit 41.

The first and second connecting frames 17 and 18 serve to firmly support the first and second axial support parts 13 and 14, which stand separately on the base body part, thereby preventing the gap between the first and second axial support parts 13 and 14 from being broadened.

The gas passage 11*a* is provided with an inlet through which exhaust gas is introduced, and outlet 11*b* through which exhaust gas is discharged so that air is sucked into an internal engine of a vehicle. The outlet 11*b* is formed such that it communicates with the hole 12*a* for the motion axis in a direction in which the valve unit 20 moves linearly. Thus, the outlet is opened and closed by the valve disc 22 when the valve-motion axis 21 movers linearly.

The second axial support part 14 is provided with the motor-accommodating part 15, in which the motor 30 is accommodated, and a through-hole 15*a* which communicates with the inside of the motor-accommodating part 15 and through which a motor shaft 31 of the motor 30 passes.

When the motor 30 is accommodated in the motor-accommodating part 15, the motor shaft protrudes between the first and second axial support parts 13 and 14 through the through-hole 15*a*.

A main gear part 60 is provided on the motor shaft such that it is meshed with the power-transmission gear unit 51. The main gear part 60 may be a pinion gear, for example.

The valve actuator 40 is provided with the actuating gear unit 41 that is meshed, on at least a portion of a circumference thereof, with the power-transmission gear unit 51 so as to rotate about a second rotation axis 41*b* supported by the valve housing 10.

The actuating gear unit 41 has a cam part 43 that is provided eccentrically from the second rotation axis 41*b* so as to push and move the valve unit 20, and the valve actuator 40 further includes a spring part 42 that elastically supports the valve unit 20.

In operation, when the actuating gear unit 41 rotates about the second rotation axis 41*b*, the cam part 43 rotates eccentrically from the center of rotation of the actuating gear unit 41 and pushes the valve unit 20 to move linearly in a direction in which the outlet 11*b* of the gas passage 11*a* is being opened. Then, when the pushing action applied to the valve unit 20 by the cam part 43 is released, the valve unit 20 is moved by the spring part 42 in a direction in which the outlet 11*b* of the gas passage 11*a* is being closed, thereby closing the outlet 11*b* again.

The cam part 43 is provided with an arcuate cam hole 43*a* on one side of the actuating gear unit 41. The valve actuator 40 includes an actuating roll part 44 that is inserted into the cam hole 43*a* so as to roll over in the cam hole 43*a*, and a roll bracket part 45 which is attached to an end of the valve-motion axis 21 and to which the actuating roll part 44 is rotatably connected.

The actuating roll part 44 rolls and moves along an inner circumferential surface of the cam hole 43*a* while coming into contact with the inner circumferential surface.

The actuating gear unit 41 is configured such that the actuating roll part 44 is inserted therein and moves, and the cam hole 43*a* eccentric from the center of rotation is integrally formed therein, thereby saving on manufacturing cost, facilitating more stable operation to open and close the gas passage 11*a*, and further improving the operation reliability.

More specifically, the cam hole 43*a* is configured such that a distal end thereof from the valve unit 20 is farther from the center of the second rotation axis 41*b* than a proximal end thereof to the valve unit 20. When the actuating roll part 44 is positioned at one end side of the cam hole 43*a* that is close to the center of the second rotation axis 41*b*, the valve unit 20 is positioned at a position where the outlet 11*b* of the gas passage 11*a* is closed, and when the actuating roll part 44 is positioned at the other end side of the cam hole 43*a* that is far from the second rotation axis 41*b*, the valve unit 20 is pushed and linearly moved so that the outlet 11*b* of the gas passage 11*a* is opened.

The roll bracket part 45 includes first and second roll supports 45*a* and 45*b* that are disposed on opposite sides of the actuating gear unit 41 to support opposite ends of a roll axis of the actuating roll part 44, and a bracket bottom part 45*c* that connects the first and second supports 45*a* and 45*b* at the outside of the actuating gear unit 41 and to which the end of the valve-motion axis 21 is attached.

The cam hole 43*a* has a shape in which the opposite sides of the actuating gear unit 41 are bored, and the first and second roll support 45*a* and 45*b* are disposed on opposite sides of the cam hole 43*a*, respectively.

The roll bracket part 45 has a shape in which the first and second roll supports 45*a* and 45*b* stand on opposite side ends of the bracket bottom part 45*c*.

The actuating gear unit 41 is integrally provided with the cam hole 43*a* in which the actuating roll part 44 rolls over. When the actuating roll part 44 is inserted in the cam hole 43*a*, opposite ends of the roll axis of the actuating roll part 44 are supported by the first and second roll supports 45*a* and 45*b* at opposite sides of the cam hole 43*a*, and the end of the valve-motion axis 21 is attached to the bracket bottom part 45*c*, so that the actuating gear unit 41, the actuating roll part 44, and the valve-motion axis 21 are arranged on a same linear line, which corresponds to a linear motion direction of the valve-motion axis 21.

Thus, the actuating gear unit 41, the actuating roll part 44, and the valve-motion axis 21 are arranged collinearly with the direction in which the valve-motion axis 21 moves linearly, so that, during operation, side force and friction force are reduced, thereby minimizing a power loss during power transmission.

The opposite ends of the second rotation axis 41*b* are coupled with and supported by the first and second axial support parts 13 and 14, respectively.

The power-transmission gear unit 51 includes a first middle gear part 51*a* meshed with the main gear part 60, and a second middle gear part 51*b* protruding from one side of the first middle gear part 51*a* so as to be meshed with the actuating gear unit 41.

The first middle gear part 51*a* and the second middle gear part 51*b* rotate concentrically about the first rotation axis 50*a*.

The power-transmission gear unit 51 and the actuating gear unit 41 driven with rotation force of the power-transmission gear unit 51 rotate about the first and second rotation axes 50*a* and 41*b*, respectively. The opposite ends of the first rotation axis 50*a* are coupled with and supported by the first and second axial support parts 13 and 14, respectively, and the opposite ends of the second rotation axis 41*b* are coupled with and supported by the first and second axial support parts 13 and 14, respectively.

The first middle gear part 51*a* and the main gear part 60 are meshed with each other such that the first middle gear part and the main gear part are disposed apart from and parallel with the actuating gear unit 41. The second middle gear part 51*b* is meshed with the actuating gear unit 41 and is disposed in the direction in which the actuating gear unit 41 and the valve-motion axis 21 move linearly.

Thus, the second middle gear part 51*b*, the actuating gear unit 41, the actuating roll part 44, and the valve-motion axis 21 are arranged along a same vertical line, so that, during operation, side force and friction force are further reduced, thereby minimizing a power loss during power transmission.

The power-transmission gear unit 51 rotates while the opposite ends of the first rotation axis 50*a* are supported by the first and second axial support parts 13 and 14, respectively, and the actuating gear unit 41 rotates while the opposite ends of the second rotation axis 41*b* are supported by the first and second axial support parts 13 and 14, respectively, so that, when rotated, the power-transmission gear unit 50 and the actuating gear unit 41 can be stably operation-controlled at a precise gear ratio with reduced vibration.

The base body part 12 is provided with a lower spring support 12*b* protruding between the first and second axial support parts 13 and 14 and having a hole 12*a* for the motion axis, wherein the lower spring support 12*b* has, on an outer circumference thereof, a circular groove in which a lower portion of the spring part 42 is inserted and seated.

The valve-motion axis 21 is provided, on an upper portion thereof, i.e. on a lower portion of the roll bracket part 45, with an upper spring support 110 by which an upper portion of the spring part 42 is supported.

A lower side of the spring part 42 is inserted around and stably supported by the lower spring support 12*b* so as to stably elastically support the valve unit 20 without being distorted when compressed and expanded.

The valve-motion axis 21 passes through the hole 12*a* of the lower spring support 12*b*, and an axial guide bushing 21*a* is provided in the hole 12*a* to guide a vertical linear motion of the valve-motion axis 21.

The axial guide bushing 21*a* is installed in the hole 12*a* for the motion axis so as to guide the valve-motion axis 21 to smoothly move in a vertical linear direction.

The axial guide bushing 21*a* is provided with a plurality of guide bushings vertically spaced apart from each other in the hole 12*a* for the motion axis, thereby allowing the valve-motion axis 21 to vertically move stably without shaking.

Any one of the first and second axial support parts 13 and 14 is provided with a motion guide slit 16 extending in a direction in which the valve unit 20 moves, and a magnet body 90 is provided in the motion guide slit 16, wherein the magnet body 90 moves along with the valve unit 20.

The magnet body 90 is connected with the valve-motion axis 21 by the upper spring support 110 and thus vertically moves along with the valve-motion axis 21. The magnet body 90 may be either an electric magnet or a permanent magnet, for example.

Although not shown, a Hall sensor connected to ECU of a vehicle is mounted in front of the magnet body 90. The Hall sensor precisely detects a position of the valve unit 20 by detecting a position of the magnet body 90, and transmits position data to the ECU of a vehicle.

The Hall sensor can precisely detect a position of an object by measuring magnetic flux Bx and Bz in two directions and calculating an output value in a magnetic flux ratio for two directions.

Since the magnet flux ratio for two directions according to a position of the magnet body 90 maintains a same value even when the magnet flux of the magnet body 90 varies as temperature varies, the Hall sensor can precisely detect a position of the magnet body 90 even with a variation in ambient temperature that is caused by a variation in temperature of exhaust gas.

The passage body part 11 is provided with the gas passage 11*a*, through which exhaust gas is introduced and discharged, and the outlet 11*b* of the gas passage 11*a* opened and closed by the valve disc 22, and the gas passage 11*a* is provided with an inclined wall 11*c* for guiding exhaust gas introduced from an inlet of the gas passage 11*a* towards the outlet 11*b* of the gas passage 11*a*.

The inclined wall 11*c* serves to smoothly guide exhaust gas introduced into the gas passage 11*a* out of the outlet 11*b* of the gas passage 11*a* without turbulence.

The valve actuator 40 further includes a rotation stopper 70 for restricting rotation of the actuating gear unit 41 to a predetermined range.

The rotation stopper 70 allows the actuating gear unit 20 to restrict a linear motion range of the valve unit 20 so as to prevent the valve unit 20 from being excessively moved and damaged in the gas passage 11*a*.

The rotation stopper 70 restricts a radius of rotation of the actuating gear unit 41 such that the actuating gear unit only rotates within a rotation range where the valve unit 20 opens and closes the outlet 11*b* of the gas passage 11*a*.

An arcuate stopper groove or hole 41*a* is provided on a lateral side of the actuating gear unit 41 to restrict a radius of rotation of the actuating gear unit 41, and the rotation stopper 70 is provided with a stopper pin 71 extending from any one of the first and second axial support parts 13 and 14 so as to be fitted into the stopper groove or hole 41*a*.

In an embodiment of the present invention, the actuating gear unit 41 is provided, on the lateral side thereof, with an arcuate stopper groove 41*a* in which the stopper pin 71 is fitted to restrict the radius of rotation of the actuating gear unit 41.

Rotation force of the motor 30 is transmitted to the actuating gear unit 41 via the power-transmission gear unit 51 so as to rotate the actuating gear unit 41.

The EGR valve may further include a housing cover 80 that covers the first and second axial support parts 13 and 14.

The housing cover 80 prevents exposure of the power transmission 50 and the valve actuator 40, which are disposed between the first and second axial support parts 13 and 14, thereby preventing failure or accident caused due to penetration of a foreign substance into gears.

The housing cover 80 may be detachably coupled to the valve housing 10, so that the housing cover may selectively open a space between the first and second axial support parts 13 and 14 to allow the maintenance of the power-transmission gear unit, the actuating gear unit 41, and the actuating roll part 44 between the first and second axial support parts 13 and 14.

An exemplary operation of the EGR valve will now be described with reference to FIGS. 5 and 6.

Figure 5:
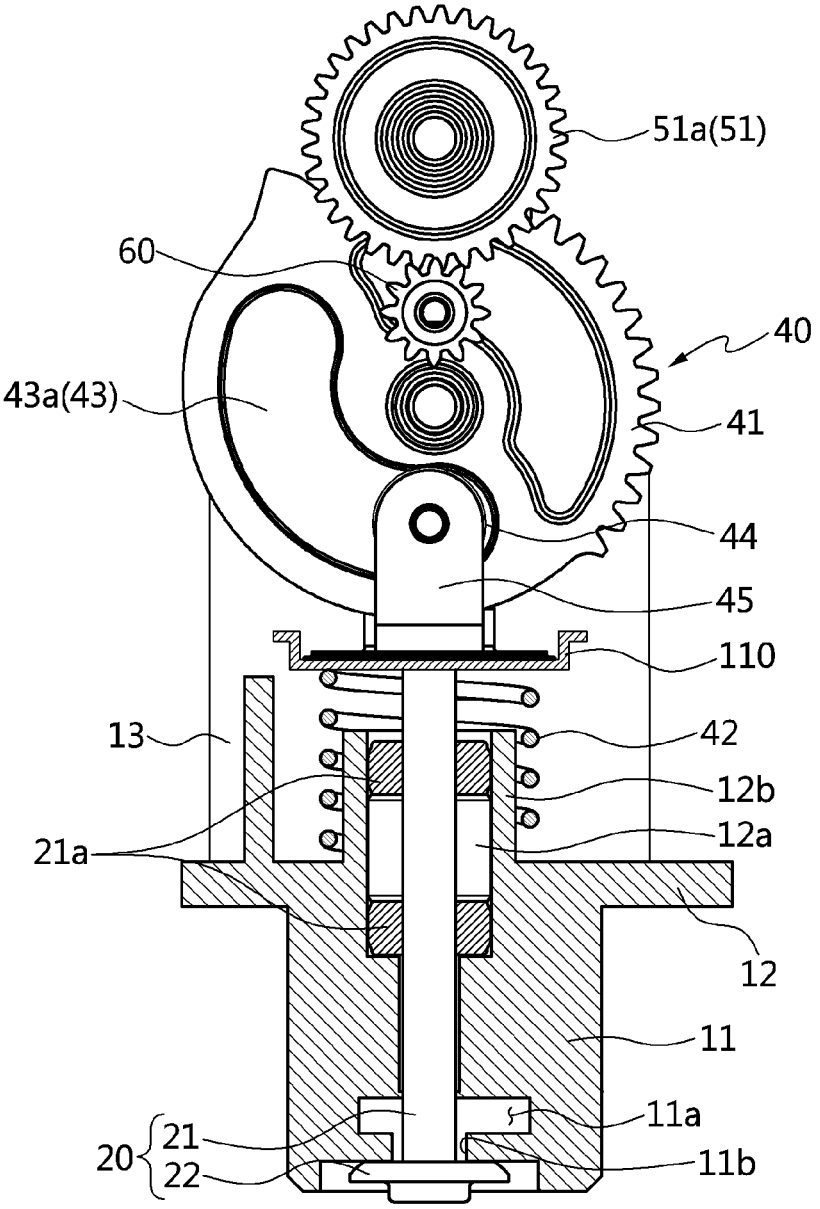
FIGS. 5 and 6 are schematic views showing exemplary operations of the exhaust gas recirculation valve having a cam structure for a vehicle.

Referring to FIG. 5, when the actuating gear unit 41 rotates with the operation of the motor 30, the actuating roll part 44 contacts and rolls along an inner circumferential surface of the cam hole 43*a* from one end side of the cam hole 43*a* towards the other end of the cam hole 43*a*. Here, since the center of rotation of the cam hole 43*a* is eccentric from the center of rotation of the actuating gear unit 41, the actuating roll part 44 is pushed and linearly moved by the actuating gear unit 41 and thus the valve-motion axis 21 is linearly moved to allow the valve disc 22 to open the outlet 11*b* of the gas passage 11*a* so that exhaust gas is introduced into an intake manifold of an internal engine.

Figure 6:
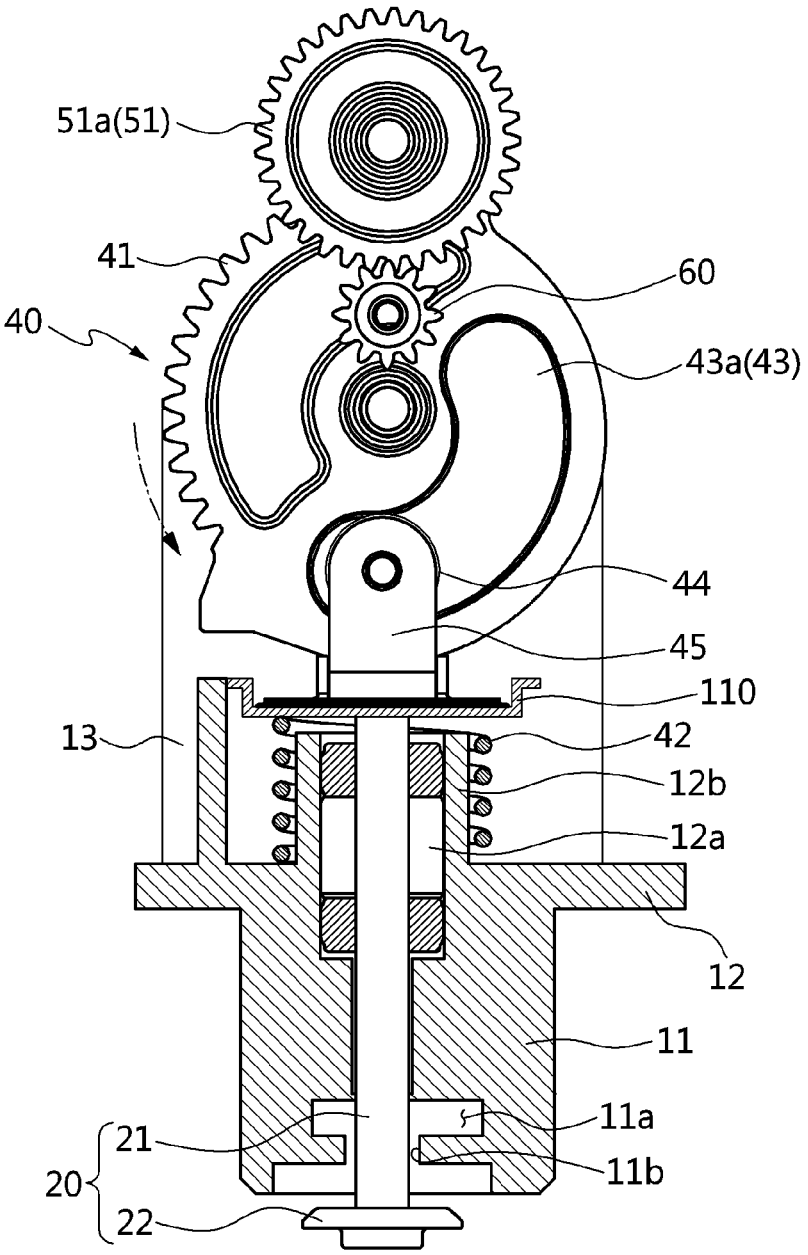

Referring to FIG. 6, when the actuating gear unit 41 rotates in the opposite direction with the operation of the motor 30, the actuating roll part 44 moves from the latter end side towards the former end side of the cam hole 43*a*. Then, when the pushing action on the actuating roll part 44 is released, the valve-motion axis 21 is linearly moved, with an elastic force of the spring part 42, in a direction in which the valve disc 22 closes the outlet 11*b* of the gas passage 11*a* so that exhaust gas is prevented from being introduced into the intake manifold of the internal engine.

Figure 7:
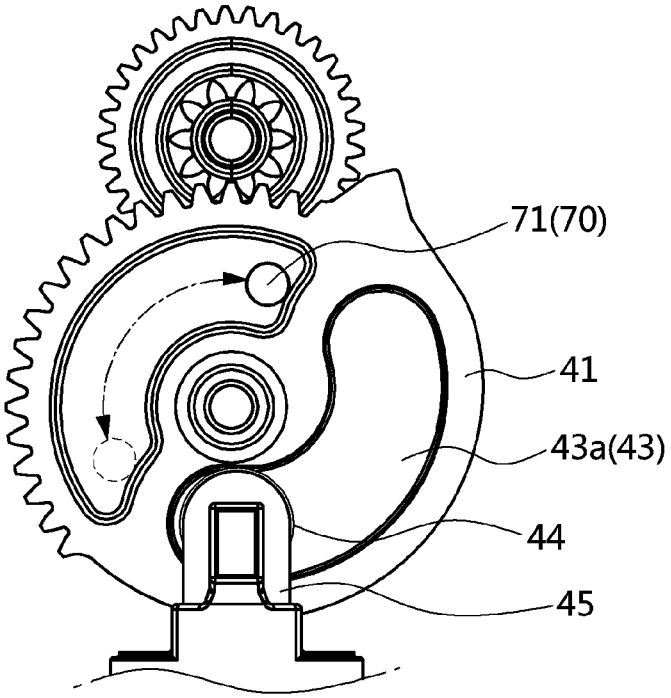
FIG. 7 is a schematic view showing the exhaust gas recirculation valve having a cam structure for a vehicle.

Referring to FIG. 7, the radius of rotation of the actuating gear unit 41 is restricted by the stopper pin 71 being only moved between the opposite ends of the stopper groove 41*a*.

That is, when an end of the stopper pin 71 is engaged with one end of the stopper groove 41*a*, the actuating gear unit 41 is restricted from being rotated in the direction in which the outlet 11*b* of the gas passage 11*a* is closed, and when the end of the stopper pin 71 is engaged with the opposite end of the stopper groove 41*a*, the actuating gear unit 41 is restricted from being rotated in the direction in which the outlet 11*b* of the gas passage 11*a* is opened.

According to the present invention, the actuating gear unit 41 for receiving rotation force from the motor 30 and the valve-motion axis 21 of the valve actuator 40 are arranged in a line so as to reduce friction force due to a reduced side force to minimize a power loss during power transmission and to ensure a stable operation for opening and closing the gas passage 11*a*, thereby improving operation reliability of the valve for the recirculation of exhaust gas.

Further, according to the present invention, with the configuration of an actuating gear unit and a cam being integrally formed, manufacturing cost is reduced and a stable operation for opening and closing the gas passage 11*a* is ensured, thereby further improving operation reliability of the valve for the recirculation of exhaust gas.

Furthermore, according to the present invention, that with the configuration of the rotation axis of the power-transmission gear unit being supported at opposite ends thereof, when the gear unit is operated, vibration is prevented from being generated, thereby improving durability of the gear unit and the rotation axis.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

As described above, optimal embodiments of the present invention have been disclosed in the drawings and the specification. Although specific terms have been used in the present specification, these are merely intended to describe the present invention and are not intended to limit the meanings thereof or the scope of the present invention described in the accompanying claims. Therefore, those skilled in the art will appreciate that various modifications and other equivalent embodiments are possible from the embodiments. Therefore, the technical scope of the present invention should be defined by the technical spirit of the claims.

What is claimed is:

1. An exhaust gas recirculation valve having a cam structure for opening and closing a gas passage through which exhaust gas from an internal engine of a vehicle is recirculated to an intake manifold, the valve comprising:

a valve housing having the gas passage through which exhaust gas is introduced and discharged;

a valve unit linearly moving to selectively open and close the gas passage;

a motor generating power to drive the valve unit;

a valve actuator receiving rotation force from the motor to drive the valve unit to move linearly; and a power transmission transmitting the rotation force from the motor to the valve actuator, wherein the valve actuator includes a power-transmission gear unit to transmit the rotation force from the motor, and the valve actuator includes an actuating gear unit that is to be rotated by being meshed with the power-transmission gear unit, and wherein the valve has a cam structure in which the power-transmission gear unit and the actuating gear unit are arranged in line with a direction of linear motion of the valve unit.

2. The valve as set forth in claim 1, wherein the actuating gear unit is integrally provided with a cam hole eccentric from center of rotation, and the valve actuator includes:

an actuating roll part inserted into the cam hole to roll over in the cam hole; and a roll bracket part provided to an end of the valve unit and to which the actuating roll part is rotatably connected.

3. The valve as set forth in claim 2, wherein the valve actuator further includes a spring part elastically supporting the valve unit.

4. The valve as set forth in claim 3, wherein the valve unit includes a valve-motion axis to be linearly moved by the valve actuator and a valve disc provided on an end of the valve-motion axis to open and close an outlet of the gas passage, and the roll bracket part includes first and second roll supports disposed on opposite sides of the actuating gear unit to support opposite ends of a roll axis of the actuating roll part, and a bracket bottom part connecting the first and second supports at the outside of the actuating gear unit and to which the end of the valve-motion axis is attached.

5. The valve as set forth in claim 4, wherein the valve housing includes:

a base body part attached to a vehicle body;

a first axial support part extending upwards from an upper surface of the base body part to support one side of the power-transmission gear unit and the actuating gear unit;

a second axial support part extending upwards from the upper surface of the base body part while being disposed apart from the first axial support part, to support the other side of the power-transmission gear unit and the actuating gear unit, and through which the motor shaft of the motor passes;

a motor-accommodating part extending from the second axial support part towards an opposite side of the first axial support part so as to accommodate the motor therein; and a passage body part extending downwards from a lower surface of the base body part to form the gas passage, through which exhaust gas is introduced and discharged, and which is opened and closed by the valve unit.

6. The valve as set forth in claim 5, wherein the valve housing further includes:

a cover for a motor-accommodating part covering an open one side of the motor-accommodating part, wherein the cover is coupled to the open one side of the motor-accommodating part to shield the inside of the motor-accommodating part after the motor is accommodated in the motor-accommodating part such that the motor shaft of the motor passes through and protrudes out of a through-hole of the second axial support part.

7. The valve as set forth in claim 5, wherein the first axial support part has a width smaller than that of the second axial support part, and the valve housing further includes:

first and second connecting frames connecting lower portions of the first and second axial support parts, respectively, and each having an upper recessed portion that is provided so as to be separated from the actuating gear unit.

8. The valve as set forth in claim 5, wherein the base body part is provided with a lower spring support protruding between the first and second axial support parts and having a hole for the motion axis, wherein the lower spring support has, on an outer circumference thereof, a circular groove in which a lower portion of the spring part is inserted and seated, and wherein the valve-motion axis is provided, on an upper portion thereof, with an upper spring support by which an upper portion of the spring part is supported.

9. The valve as set forth in claim 8, wherein the valve-motion axis passes through the hole for the motion axis, and wherein an axial guide bushing is provided in the hole to guide a vertical linear motion of the valve-motion axis.

10. The valve as set forth in claim 9, wherein the axial guide bushing is provided with a plurality of guide bushings spaced apart from each other in the hole for the motion axis.

11. The valve as set forth in claim 5, wherein any one of the first and second axial support parts is provided with a motion guide slit extending in a direction in which the valve unit moves, and wherein the valve further includes: in the motion guide slit, a magnet body that is connected with and moves along with the valve unit; and a Hall sensor for detecting a position of the magnet body.

12. The valve as set forth in claim 5, wherein the passage body part is provided with the gas passage, through which exhaust gas is introduced and discharged, and the outlet of the gas passage opened and closed by the valve disc, and wherein the gas passage is provided with an inclined wall for guiding exhaust gas introduced from an inlet of the gas passage towards the outlet of the gas passage.

13. The valve as set forth in claim 5, wherein the valve actuator further includes a rotation stopper for restricting rotation of the actuating gear unit to a predetermined range.

14. The valve as set forth in claim 13, wherein an arcuate stopper groove or hole is provided on a lateral side of the actuating gear unit to restrict a radius of rotation of the actuating gear unit, and wherein the rotation stopper is provided with a stopper pin extending from any one of the first and second axial support parts so as to be fitted into the stopper groove or hole.

15. The valve as set forth in claim 2, wherein the cam hole is configured such that one side thereof is close to a rotation axis of the actuating gear unit and the other side thereof is far from the rotation axis of the actuating gear unit.

16. The valve as set forth in claim 2, wherein a main gear part is provided on a motor shaft of the motor, and the power-transmission gear unit includes:

a first middle gear part meshed with the main gear part; and a second middle gear part having a smaller diameter than the first middle gear part and protruding from one side of the first middle gear part so as to be meshed with the actuating gear unit, wherein the second middle gear part, the actuating gear unit, the actuating roll part, and the valve-motion axis are arranged along a same vertical line.

17. The valve as set forth in claim 16, wherein the first middle gear part and the main gear part are meshed with each other such that the first middle gear part and the main gear part are disposed apart from and parallel with the actuating gear unit.

* * * * *